United States Patent [19]

Uzaki et al.

[11] Patent Number: 4,531,565

[45] Date of Patent: Jul. 30, 1985

[54] GAS HARDENING TYPE MOLDING MACHINE

[75] Inventors: Nagato Uzaki, Toyohashi; Kazuharu Matui, Toyokawa; Shigehiro Toyoda, Toyokawa; Katuro Hikita, Toyokawa, all of Japan

[73] Assignee: Sintokogio Ltd., Nagoya, Japan

[21] Appl. No.: 428,722

[22] Filed: Sep. 30, 1982

[30] Foreign Application Priority Data

Nov. 24, 1981 [JP] Japan ..... 56-188618

[51] Int. Cl.[3] ..... B22C 15/24

[52] U.S. Cl. ..... 164/160.1; 164/7.1; 164/200; 164/401

[58] Field of Search ..... 164/16, 131, 347, 401, 164/7.1, 160.1, 200

[56] References Cited

U.S. PATENT DOCUMENTS 3,172,173 3/1965 Ellms ..... 164/192
4,291,740 9/1981 Michelson ..... 164/7.1
4,417,616 11/1983 Seitz ..... 164/342

FOREIGN PATENT DOCUMENTS 48-14290 5/1973 Japan ..... 164/16
0740399 6/1980 U.S.S.R. ..... 164/347

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

Disclosed is a gas hardening type molding machine wherein a vertical type molding box is disposed under a molding sand hopper having an upper part opened and a bottom part provided with a sand discharge port, and a mold cavity in the vertical split type molding box is communicated with both a vacuum device and a hardening gas generator through stop valves, thereby to conduct both the filling of molding sand and the permeation of a hardening gas by utilizing the suction operation of the vacuum device.

3 Claims, 4 Drawing Figures

GAS HARDENING TYPE MOLDING MACHINE

BACKGROUND OF THE INVENTION

1. Field of the Invention

The present invention relates to a molding machine for forming molds by making use of molding sand containing a gas hardenable binder, and more particularly, to a molding machine arranged such that binder-containing molding sand is filled in the cavity of a vertical split type molding box under suction and hardened by allowing a hardening gas to flow therethrough under suction.

2. Description of the Prior Art

In a method which has recently been proposed, while air inside the molding box cavity is being extracted so that the pressure therein is reduced, molding sand containing a gas hardenable binder is sucked into the cavity so as to fill up the same and moreover, under suction a hardening gas is allowed to flow through the molding sand so as to harden the same, thereby to form a mold.

It is known that the above-mentioned molding method is much suitable for, e.g., manufacture of cores using a vertical split type molding box. This is because suction applied to the vertical split type molding box allows the box to be firmly clamped by means of the peripheral atmospheric pressure, so that it does not need any strong clamping device.

However, any molding machine which massproduces molds by employing the above-mentioned molding method has not been proposed yet, and there has been a great demand for development of such a molding machine.

SUMMARY OF THE INVENTION

It is, therefore, an object of the present invention to provide a molding machine for massproduction of molds by means of such a method that the supply of molding sand and a hardening gas therethrough as well is made under suction.

Another object of the present invention is to provide a gas hardening type molding machine capable of forming molds by employing a molding box with a lower strength.

Still another object of the present invention is to provide a gas hardening type molding machine easy to remove formed molds.

A further object of the present invention is to provide a gas hardening type molding machine capable of forming molds at low cost and consequently economically advantageous as well as capable of prevention of pollution.

The above-mentioned and other objects, features and effects of the present invention will be made clearer from the following description of nonexclusive embodiments of the present invention taken in connection with the accompanying drawings.

DETAILED DESCRIPTION OF THE PREFERRED EMBODIMENTS

Figure 1:
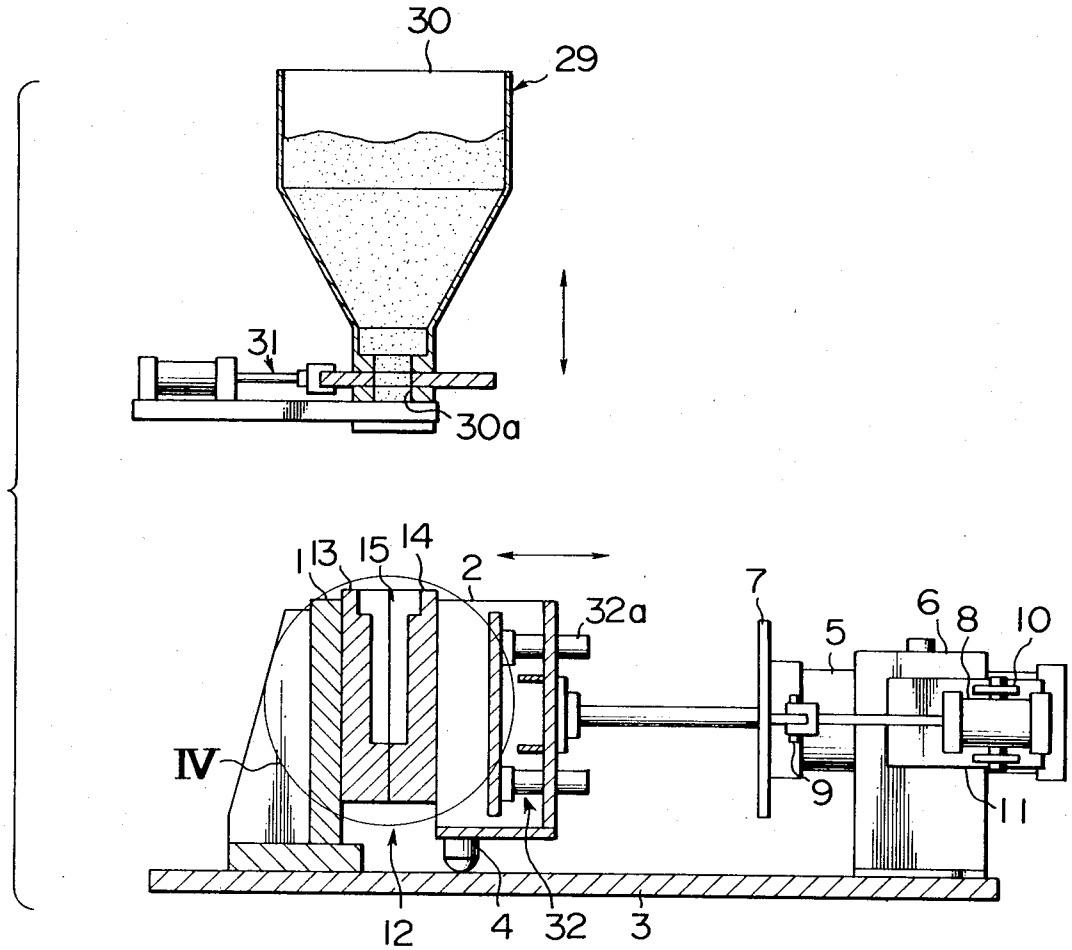
FIG. 1 illustrates a preferred embodiment of the present invention by way of partly-sectioned front elevational views.
Figure 2:
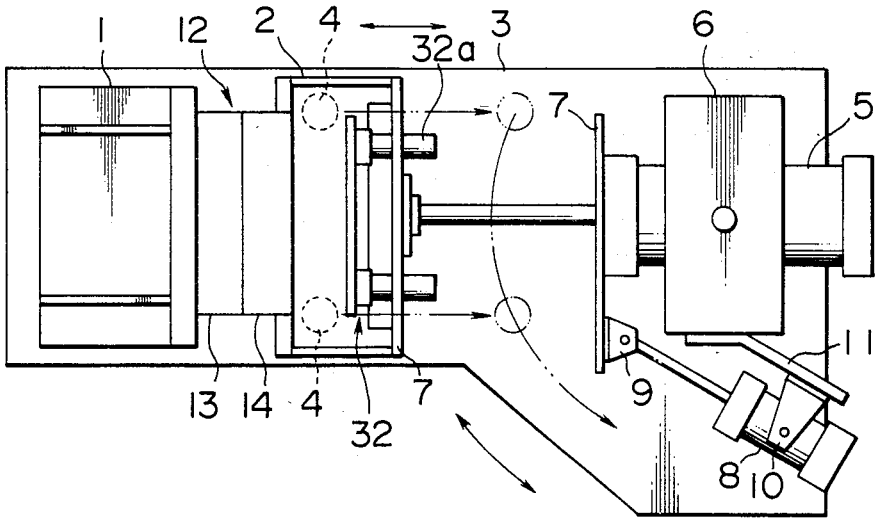
FIG. 2 is a plan view of an essential part of the preferred embodiment of the present invention.
Figure 3:
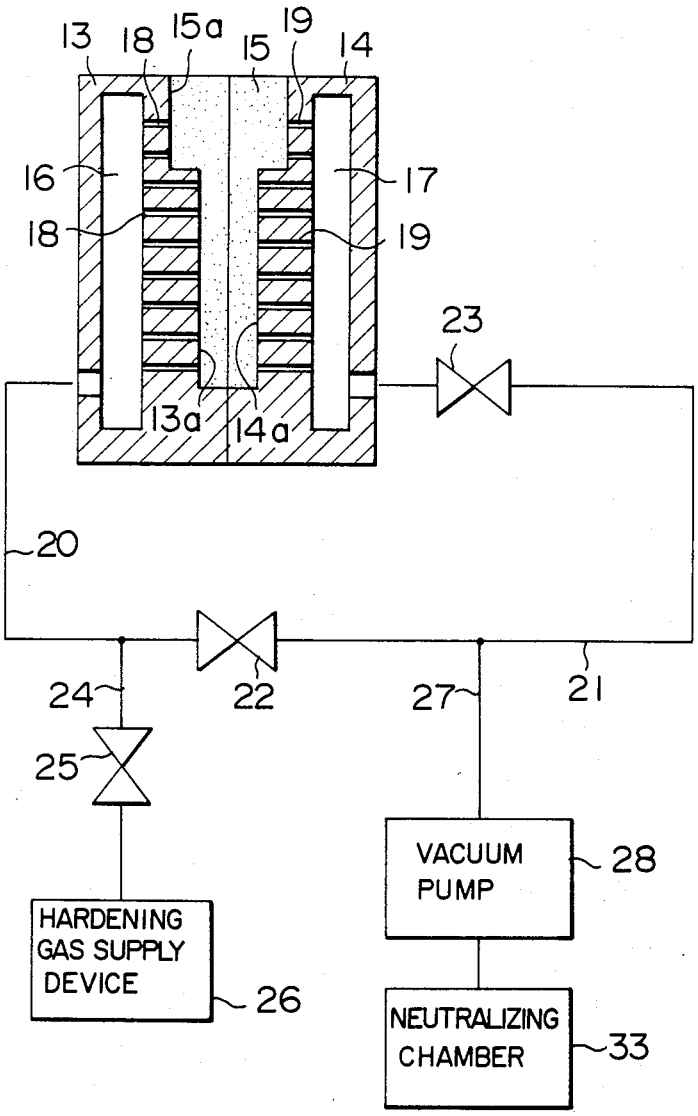
FIG. 3 is an enlarged detail view of a part B in FIG. 1.

A first preferred embodiment of the present invention will be described hereinunder with reference to FIG. 1 thru FIG. 3. Reference numerals 1 and 2 designate a fixed die base and a movable die base, respectively, on which a vertical split type molding box 12, described later, is mounted. The fixed die base 1 is secured at a left position on a bed 3 having a horizontal surface. The movable die base 2 is horizontally movably mounted on the bed 3 through two ball casters 4 attached to the lower surface of the die base 2, and the end of the piston rod of a horizontal cylinder 5 is secured to the rear surface of the movable die base 2, which cylinder 5 is horizontally rotatably supported on the bed 3 through a support member 6, so that the movable die base 2 is reciprocated right and left by extending and retracting operations of the cylinder 5.

Moreover, a rectangular flat plate member 7 is secured to the forward end cap of the cylinder 5, and the end of the piston rod of a cylinder 8 is horizontally rotatably connected to the front side (lower side as viewed in FIG. 2) of the rear surface of the flat plate member 7 through a joint mechanism 9. The cylinder 8 is mounted on the front side (lower surface as viewed in FIG. 2) of the support member 6 through a pivotably supporting member 10 and a bracket 11 so that the central axis of the cylinder 8 crosses that of the cylinder 5, thereby allowing the cylinder 5 to horizontally rotate between a position where it faces to the fixed die base 1 and a position where the cylinder 5 is directed to the left lower side as viewed in FIG. 2 in accordance with extending and retracting operations of the cylinder 8. The vertical split type molding box 12 comprises a fixed wooden die part 13 mounted on the fixed die base 1 and a movable wooden die part 14 mounted on the movable die base 2 and has a mold cavity 15 provided with a suction port 15*a* for molding sand formed at its upper end position. In addition, the fixed wooden die part 13 and the movable wooden die part 14 have hollow chambers 16, 17 formed therein respectively, which are communicated with cavity surfaces 13*a* 14*a* defining the mold cavity 15 through a plurality of vent holes 18, 19, respectively, fitted with vent plugs (not shown). The hollow chambers 16, 17 are communicated with each other through conduits 20, 21 and stop valves 22, 23. The conduit 20 is communicated with a hardening gas supply device 26 through a branch pipe 24 and a stop valve 25, while the conduit 21 is communicated with a vacuum pump 28 through a branch pipe 27. A hopper 29 for accomodating molding sand is disposed so as to be able to move to a position directly above the molding box 12 in a closed state, and comprises a hopper main body 30 having an uppper end opened and a gate machanism 31 for opening or closing a discharge port 30*a* of the hopper main body 30. An ejecting mechanism 32 for ejecting the mold attached to the cavity surface 14*a* of the movable wooden die part 14 through ejecting pins (not shown) is incorporated in the movable die base 2. In addition, a reference numeral 32*a* denotes an actuating plunger of the ejecting mechanism 32.

The operation of the apparatus thus arranged will be described hereinunder. The hopper 29 accomodating molding sand containing a gas hardenable binder is downwardly moved in order to connect the discharge port 30*a* to the suction port 15*a* of the molding box 12, and with the vacuum pump 28 being maintained in an operative state, the stop valves 22, 23 are opened in order to suck the air inside the mold cavity 15 of the molding box 12 so that the pressure therein is reduced, and the gate mechanism 31 is opened for a necessary period of time so that the molding sand is sucked into the mold cavity 15 so as to fill up the same. Then, the hopper 29 is upwardly moved in order to separate the discharge port 30*a* from the suction port 15*a*. After the suction port 15*a* is shut by using a proper means such as a rubber sheet or plastic film, the stop valve 22 is closed while the stop valve 25 is opened in order to introduce the hardening gas stored in the hardening gas supply device 26 into the mold cavity 15 through the conduit 20, the hollow chamber 16 and the vent holes 18 in order to and allow the hardening gas to flow through the molding sand in the mold cavity 15, thereby to harden the molding sand. The hardening gas after hardening the molding sand is introduced into a neutralizing chamber 33 connected to the vacuum pump 28, through the vent holes 19, the hollow chamber 17, the stop valve 23 and the conduit 21 in order and is neutralized there before being discharged into the atmospheric air. After a time needed for hardening the molding sand has passed, the stop valve 25 is closed in order to suspend the supply of the hardening gas and the stop valve 23 is closed in order to stop the suction. Then, the movable wooden die part 14, together with the movable die base 2, is rightwardly moved by the retracting operation of the cylinder 5, thereby to allow an ejecting pin (not shown) provided in the fixed wooden die part 13 to eject the hardened molding sand from the cavity surface of the fixed wooden die part 13 and at the same time, with the hardened molding sand being attached to the cavity surface 14*a* of the movable wooden die part 14, the molding box 12 is opened. The movable die base 2 is moved by a given distance and stopped, and the cylinder 5 is horizontally and counterclockwise rotated by the retracting operation of the cylinder 8 in order to direct the cylinder 5 toward the operator. The die base 2 is further retreated by the retracting operation of the cylinder 5 until the actuating plungers 32*a* of the ejecting mechanism 32 abut against the flat plate member 7, and the ejecting pin (not shown) provided in the movable wooden die 14 is actuated to eject the hardened molding sand from the cavity surface 14*a*, thereby to obtain a desired mold. Thereafter, the cylinder 8 is extended in order to restore the cylinder 5 to its initial state, and the movable die base 2 is leftwardly moved by the extending operation of the cylinder 5 in order to close the molding box 12, thereby to complete one cycle.

Figure 4:
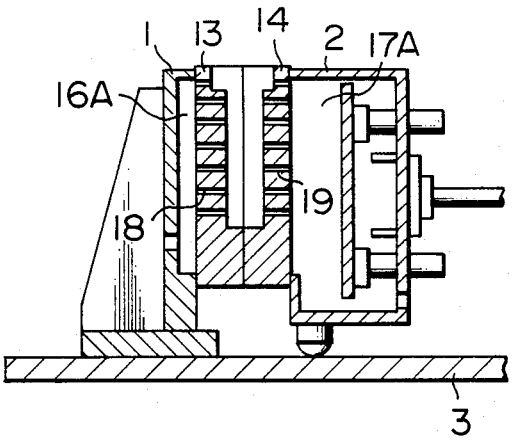
FIG. 4 is a partly-sectioned front elevational view of another preferred embodiment of the present invention.

Although the hollow chambers 16, 17 according to the above-mentioned preferred embodiment are communicated with the hardening gas supply device 26 through the circuit incorporating the vacuum pump 28, at least one of the hollow chambers may be communicated with the hardening gas supply device 26 independently provided through a stop valve. Moreover, although the fixed die base 1 according to the preferred embodiment is secured on the bed 3, the fixed die base 1 may be of movable type such as the movable die base 2. Furthermore, although the hollow chambers 16 17 according to the preferred embodiment are formed inside the split die parts 13 14 respectively, the hollow chambers may be defined by recesses 16A 17A, formed in the split die part mounting surfaces of the fixed and movable die bases 1 2, respectively, and the rear surfaces of the split die parts 13 14, as shown in FIG. 4.

As will be fully understood from the foregoing description, according to the first aspect of the invention, since the two die bases mountd with the vertical split die parts having the mold cavity communicated with both the vacuum device and the hardening gas supply device are disposed below the hopper which is so arranged as to be vertically movable and is provided with the hopper main body having its upper end opened, and since at least one of the two die bses is adapted to be horizontally movable, molding sand can be filled up in the mold cavity and the hardening gas can be made to flow through the molding sand under suction. Accordingly, a small-sized clamping device with a smaller clamping force can be used for clamping the wooden die parts, so that the molding machine becomes compact, lightweight and cheap. In addition, such effects are presented that a wooden molding box can be used and the wear thereof is reduced. On the other hand, according to the second aspect of the invention, since besides the first aspect of the invention, the movable die base adapted to be horizontally movable is mounted on the bed through the casters and the end of the piston rod of the first cylinder hoirizontally rotatably supported is secured to the rear surface of the movable die base, and since the end of the piston rod of the second cyulinder horizontally rotatably supported is horizontally rotatably connectd to the first cylinder, the movable wooden die part in an open state can be directed toward the operator by the retracting operation of the second cylinder. Accordingly, such excellent effects are provided that the operation for removing a mold from the die parts is largely facilitated and moreover the whole apparatus becomes compact, lightweight and cheap.

What is claimed is:

1. A gas hardening type molding machine comprising:

a pair of vertical split die parts forming together a molding box and each having a hollow chamber and a plurality of vent holes for communicating said hollow chamber and a mold cavity with each other;

a pair of die bases comprising a fixed and a movable die base, having said pair of vertical split die parts mounted thereon respectively such that said movable die base having casters for movement thereon, is movable horizontally on a bed relative to said fixed die base;

a die base moving device comprising a cylinder supported by a stationary support member on said bed and having a piston rod connected to said movable die base to move said movable die base in a straight line relative to said fixed die base between a first position where said pair of vertical split die parts are assembled and a second position where said pair of vertical split die parts are separated from each other;

a gas hardenable molding sand supply hopper having an upper part opened in the atmospheric air and a bottom part provided with a discharge port, said hopper being vertically movable with respect to said pair of vertical split die parts assembled at said first position;

a hardening gas supply device communicable with one of the hollow chambers of said pair of vertical split die parts; and a vacuum device with at least the other of said hollow chambers of said pair of vertical split die parts, wherein said fixed die base is secured to said bed, while said movable die base is movable on the upper surface of said bed, and wherein said die base moving device has a second piston rod and a second cylinder supported horizontally and rotatably by said stationary support member and said second piston rod pivotally attached to said cylinder at a plate member disposed on said cylinder, such that when the piston rod of said cylinder is retracted to said second position, said second piston rod of said second cylinder retracts to pull said movable die base in an arc on said casters to a position where said movable die base does not face said fixed die base.

2. A gas hardening type molding machine as defined in claim 1, wherein said one of said hollow chambers of said pair of vertical split die parts is communicated with said hardening gas supply device through a first stop valve, said hollow chambers being communicated with said vacuum device through second and third stop valves respectively.

3. A gas hardening type molding machine as defined in claim 1, having a gate mechanism for opening or closing said discharge port of said hopper, said discharge port being adapted to be hermetically adjusted to a molding sand suction port formed in the upper part of said mold cavity defined by said pair of vertical split die parts in an assembled state.

* * * * *